US008286710B2

(12) United States Patent
Chaplin et al.

(10) Patent No.: US 8,286,710 B2
(45) Date of Patent: Oct. 16, 2012

(54) VALVE ASSEMBLY

(75) Inventors: Michael John Chaplin, Nr Nuneaton (GB); Simon Christopher Ash, Newark (GB)

(73) Assignee: Reeves Wireline Technologies Limited, Leicestershire (GB)

( * ) Notice: Subject to any disclaimer, the term of this patent is extended or adjusted under 35 U.S.C. 154(b) by 307 days.

(21) Appl. No.: 12/604,214

(22) Filed: Oct. 22, 2009

(65) Prior Publication Data

US 2010/0108332 A1 May 6, 2010

(30) Foreign Application Priority Data

Sep. 22, 2009 (GB) ..... 091626.5

(51) Int. Cl.
*E21B 34/14* (2006.01)
*E21B 34/06* (2006.01)

(52) U.S. Cl. ..... 166/332.8; 166/254.2; 166/332.4

(58) Field of Classification Search ..... 166/254.2, 166/332.4, 332.8, 386
See application file for complete search history.

(56) References Cited

U.S. PATENT DOCUMENTS 3,942,551 A 3/1976 Schuller et al.
4,706,933 A 11/1987 Sukup et al.
5,145,005 A * 9/1992 Dollison ..... 166/332.8

FOREIGN PATENT DOCUMENTS

CN 201265392 7/2009
GB 2255118 10/1992
GB 2389128 12/2003

OTHER PUBLICATIONS

D.P. Harness, Patents Act 1977; Search Report under Section 17(5), Jan. 8, 2010, 4 pages, UK Intellectual Property Office, UK.

* cited by examiner

*Primary Examiner* — Brad Harcourt
(74) *Attorney, Agent, or Firm* — Mark A. Oathout; Oathout Law Firm

(57) ABSTRACT

A valve assembly (10) comprises a drillpipe (11) defining a hollow, generally cylindrical interior having secured therein a valve member (12) that is moveable between an open position, permitting passage of an object through the valve (10), and a closed position preventing passage of fluids along the drillpipe (11). A resiliently contractile arm (17) interconnects the valve member (12) and the drillpipe (11) so as to urge the valve member (12) towards the closed position and such that when an object passes along the drillpipe (11) and engages the valve member (12) or the arm (17) the valve member (12) occupies the open position.

17 Claims, 6 Drawing Sheets

VALVE ASSEMBLY

CROSS-REFERENCE TO RELATED APPLICATIONS

This application claims the foreign priority of GB patent application number 0916626.5 filed Sep. 22, 2009.

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A "SEQUENCE LISTING", A TABLE, OR A COMPUTER PROGRAM

Not Applicable.

BACKGROUND AND SUMMARY OF THE INVENTION

This invention relates to a valve assembly, in particular of a kind intended for use in drillpipe.

As is well known, drillpipe is extensively used in the oil and gas industries. Drillpipe consists of lengths (referred to as "stands") of rigid metal pipes that are cylindrical, are hollow and are capable of being threadedly secured one to another.

Drillpipe is introduced into a wellbore or other borehole typically in a "stand by stand" fashion in which successive stands are added from a surface location to drillpipe stands that are secured seriatim to one another and are already at least partly inserted into the wellbore. Each stand of drillpipe added in this way is lowered into the borehole in order to advance the assembled drillpipe along the wellbore until it reaches a chosen depth (that may be thousands or even tens of thousands of feet from the surface location).

Drillpipe is used in a wide variety of situations. It is usually inserted into a wellbore that has not been "completed", i.e. the well has not been "cased". This is achieved by running a liner and through the creation of a cement annulus that contains fluids in the geological formation surrounding the wellbore so as to prevent them from rising up the wellbore under naturally occurring pressure.

Drillpipe therefore must be capable of resisting the fluid pressures that arise in subterranean formations. To this end each stand of drillpipe is manufactured as a cylinder of a rigid metal (e.g. steel) that may easily accommodate such pressures when they act on the exterior surface of the drillpipe.

Each stand however is open at each end such that the drillpipe would, in the absence of precautionary measures, constitute a continuous pipe extending from one end, deep inside a wellbore, to the other at a surface location.

This feature of drillpipe is needed because in normal use the drillpipe is filled with a fluid that is pressurised to permit the conveying of objects (typically oilfield tools) along the drillpipe so as to protrude from the remote end of the drillpipe and perform an operation. From time to time however it may happen that fluid under pressure in the geological formation acts on the subterranean end of the drillpipe. If the pressure in such fluid is great enough it forces the drillpipe fluid (and, potentially, any objects in it) along the drillpipe towards and out of its surface end. This phenomenon is known as "kicking" of the well.

Aside from the fact that the emergence (possibly at great speed) of drillpipe fluid and objects from the drillpipe is potentially extremely hazardous, the action of formation fluid pressure inside the drillpipe may damage the drillpipe itself or any objects supported in it. In such a case it potentially becomes necessary to withdraw perhaps many tens or hundreds of stands of drillpipe from the wellbore and disconnect them one by one until the damaged section is at a surface location and can be replaced.

In some situations a damaged object inside drillpipe may become stuck. This makes it difficult to recover the object. This is inconvenient if the object in question is an expensive oilfield tool; and it may be very costly in terms of delays in "productionising" an oil or gas well.

In order to prevent formation fluid pressure from propagating along the whole length of a drillpipe certain stands that are installed at intervals along drillpipe include flapper valves that close off the interior of the drillpipe to the passage of fluid.

As indicated the interior cross section of the drillpipe is circular and the known flapper valves typically consist of a circular valve member that is of the same diameter as the drillpipe interior.

Such a valve member is pivotably secured at one edge to the inside of the drillpipe wall. A spring acts between the valve member and the drillpipe wall to force the valve member towards a closed position. The drillpipe includes an annular shoulder or similar formation against which such spring pressure forces the outer edge of the valve member so as to seal the drillpipe.

The spring acts in one direction only on the valve member. The valve is configured such that any formation fluid pressure (or other fluid pressure) acting inside the drillpipe acts in the same direction thereby sealing the drillpipe more firmly. Thus in the event of the well kicking the formation fluid pressure tends to enhance the sealing provided by the flapper valve and prevent the formation fluid from having the deleterious effects mentioned above.

Drillpipe is used to convey well survey tools to great depths in wellbores. On such occasions the tools are lowered through the drillpipe (usually but not always supported on wireline, the nature and functions of which will be familiar to those of skill in the art) to protrude at the downhole end. They may perform surveying and logging operations before being retrieved to a surface location.

A tool deployed in this fashion typically engages a landing ring formed in the drillpipe stand at the downhole end of the drillpipe. The landing ring prevents the tool from emerging completely from the drillpipe, with the result that the tool protrudes while being retained captive relative to the drillpipe. The exposed tool then logs data from the formation and stores it in an on-board memory for later use.

In an example such as this there may be no direct communication link between the tool and the surface location (where operators such as logging engineers and analysts may be located together with computers that are capable of processing signals, generated by the tool, into data that may be stored and/or presented as logs). Therefore it is necessary to retrieve the tool to a surface location before it will yield any useful data.

Even when the tool remains connected by wireline to the surface location during logging it is essential to retrieve the tool to the surface after logging activity has ceased.

The flapper valve described above is suitable to permit deployment of the tool in the downhole direction. This is because as the tool approaches the valve member either the pressure of pumped drillpipe fluid, or physical engagement of the tool with the valve member, is enough to pivot the valve member to its open position against the action of the spring.

On the other hand the nature of the flapper valve prevents return of the tool in the uphole direction by reason of the normally closed, one-way nature of the valve member. Therefore until now the only technique available for retrieving a landed tool has been to withdraw the drillpipe stand by stand.

This is very time-consuming and is particularly undesirable if it is required to leave the drillpipe in position following a logging operation.

The invention seeks to solve or at least ameliorate one or more disadvantages of the prior art arrangements.

According to the invention in a first aspect there is provided a valve assembly comprising a pipe member defining a hollow, generally cylindrical interior having secured therein a valve member that is moveable between an open position, permitting passage of an object through the valve in first and second, opposite directions, and a closed position preventing passage of fluids along the pipe member in one of the first and second directions; and a resiliently contractile arm interconnecting the valve member and the pipe member so as to urge the valve member towards the closed position and such that when an object passes along the pipe member and engages the valve or the arm the valve member moves towards the open position.

Such an arrangement permits a deployed downhole tool, such as but not limited to a logging tool, to be pumped or withdrawn on wireline to an uphole location through the valve without having to remove the drillpipe via which it is deployed.

Conveniently the valve assembly includes a recess in which the valve member is receiveable when in its open position.

In a preferred embodiment of the invention the valve member includes a first pivot, on a first side, securing the valve member and the pipe member together; and a second pivot, on an opposite side, securing the valve member and the resiliently contractile arm together.

This arrangement ensures that drillpipe pressure acting in the downhole direction and/or contact of a conveyed tool with the valve member provides a sufficient force to open the valve member and permit the passage of an object such as a tool in the downhole direction.

Conveniently the first pivot lies at an edge of the recess. This arrangement is advantageously compact.

It is also preferable that the resiliently contractile arm is secured at a first end to the valve member and at a second end, that is remote from the first end, to the pipe member.

This feature ensures that even when a tool or other object is pulled in an uphole direction it encounters a part of the valve against which it may bear in order to achieve opening of the valve to permit its uninterrupted passage up the drillpipe.

In a preferred embodiment of the invention the resiliently contractile arm includes a first, hollow arm member having slidably received therein a further, hollow arm member, the first and further arm members being interconnected inside the first said member by a resiliently deformable element. Other arrangements of the contractile member however are possible within the scope of the invention.

In a second aspect the invention resides in a method of using a logging tool comprising the steps of:

(i) causing the tool to move in a downhole direction along drillpipe including at least one valve assembly as defined herein such that the tool passes through at least one said valve assembly in a forward direction;

(ii) deploying the tool at the downhole end of the drillpipe;

(iii) subsequently causing the tool to move in an uphole direction along the drillpipe such that the tool passes through at least one said valve assembly in a reverse direction.

Conveniently the step (i) includes contact between a downhole part of the logging tool and the valve member so as to urge the valve member towards its open position; and the step (iii) includes contact between an uphole part of the logging tool and the resiliently contractile arm, also so as to urge the valve member towards its open position. Such contact between a downhole part of the logging tool and the valve member however may not always be needed. It may be possible to open the valve, when it is desired to move the logging tool in a downhole direction, using drillpipe fluid pressure alone.

It is further preferable that when moving along the drillpipe the logging tool is connected to wireline.

When the logging tool is so configured optionally the method includes the sub-step of, after step (ii), disconnecting the logging tool from wireline to which it is connected. Following such disconnection, or if the logging tool is initially deployed without the use of wireline, the method of the invention may include the optional sub-step of, before step (iii), connecting the logging tool to wireline.

It is however possible to perform the method of the invention without making use of wireline at all. To this end in an alternative embodiment the method of the invention may be such that when moving along the drillpipe the logging tool is pumped under the influence of drillpipe fluid pressure. This version of the method is of particular benefit when the logging tool is of the compact battery/memory (or "slimhole") type, although it may also be practised when using other logging tool types.

Preferably therefore the tool includes an on-board memory, and the method includes the step of operating the tool following deployment at the downhole end of the drillpipe in order to record in the memory data pertaining to a geological formation in the vicinity of the said downhole end.

It is also preferable that the method includes the step of, after causing the tool to move in an uphole direction, retrieving the tool to a surface location and downloading data stored in the memory.

Such steps permit the method of the invention to be of particular utility in the data logging art.

As used herein the terms "uphole" and "downhole" are to be construed in accordance with their conventional meanings in the oil and gas drilling art, as will be known to the worker of skill. In consequence the valve assembly of the invention normally is installed such that the resiliently contractile arm lies on the downhole side of the valve member. It may however be desirable from time to time to install the valve assembly such that the contractile arm lies on the uphole side of the valve member.

Such use of the valve assembly is believed to be only rarely desired, but for the avoidance of doubt it nonetheless lies within the scope of the invention.

BRIEF DESCRIPTION OF THE SEVERAL VIEWS OF THE DRAWING(S)

There now follows a description of a preferred embodiment of the invention, by way of non-limiting example, with reference being made to the accompanying drawings in which.

DETAILED DESCRIPTION

Figure 1:
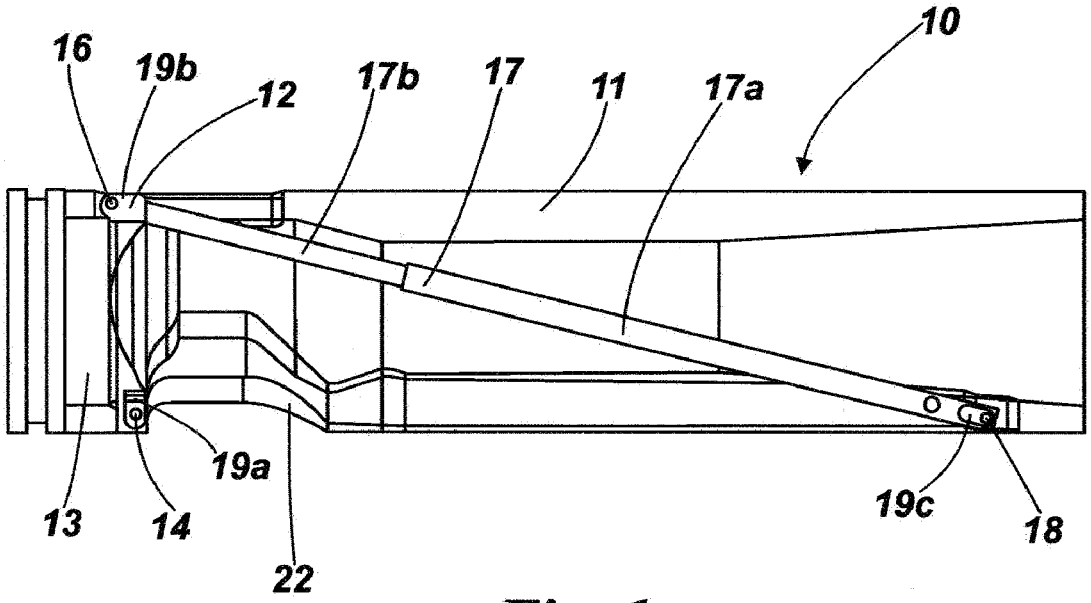
FIG. 1 is a side elevational, partly sectioned view of a first embodiment of valve assembly, according to the invention, in its closed configuration.

Referring to the drawings a valve assembly 10 for inclusion in a drillpipe string is constituted essentially by a hollow, cylindrical pipe member 11 and a valve member 12.

Pipe member 11 is made from a rigid metal such as a steel and is an elongate, hollow cylinder that is open at each end. The ends of the pipe member 11 are threaded respectively with male (downhole end) and female (uphole end) threads so pipe member 11 can be secured in a per se known manner in a series of drillpipe stands. The threaded portions are omitted from the drawings since they are not necessary for an explanation of the invention. Indeed, other means than threaded end portions, of securing the drillpipe may be employed if desired.

Valve member 12 is moveable from between a closed position as shown in FIG. 1 to an open position described below and visible in FIG. 3.

In the closed position the valve member seats against a shoulder in the form of an annular collar 13. Collar 13 extends about the inner periphery of pipe member 11 adjacent one end thereof. Collar 13 is of lesser diameter than the remainder of the interior of pipe member 11.

Valve member 12 essentially is a circular disc that is pivotably secured, as described below, so as to be moveable between the closed and open positions. The diameter of valve member 12 is such that when it bears against the collar 13 the otherwise open passage through the pipe member 11 is sealed off and no fluid can flow in the uphole direction along the drillpipe via its two ends.

Valve member 12 is moveably secured (in the embodiment shown) by way of a pin-jointed first pivot 14 at an edge to the inner surface of the wall of the pipe member 11.

A second, similar pivot 16 is defined on the periphery of the valve member 12 at a location that is diametrically opposite that of pivot 14. An elongate, resiliently contractile arm 17 is secured to the second pivot 16 so that the arm 17 and the valve member 12 are rotatable relative to one another.

When valve assembly 10 is installed as shown the arm 17 extends away from second pivot 16 in the in-use downhole direction. At its end remote from second pivot 16 arm 17 is secured to the wall of pipe member 11 by way of a third, pin jointed pivot 18. As a result arm 17 is pivotable relative to the wall of pipe member 11.

Each of the pivots is in the embodiment shown formed as a perforated tab or ear 19*a*, 19*b*, 19*c* respectively through which a pivot pin 21 passes. Each pivot pin is secured in a per se known fashion in order to provide for free pivoting motion.

Other ways of forming the pivots are possible within the scope of the invention and will be known to the worker of skill.

The arm 17 is resiliently contractile. In other words it is contractible against a resilience that tends to resist such contraction. The contraction in the embodiment shown is arranged to occur in the elongate direction of the arm 17, in accordance with a preferred construction described below.

Figure 2:
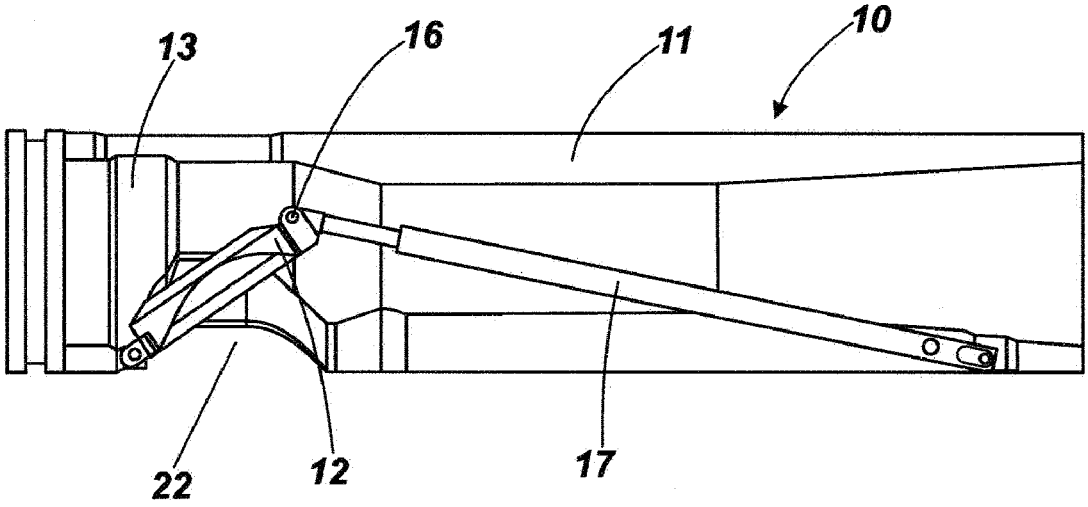
FIG. 2 is a view similar to FIG. 1 showing the valve assembly in a partly open configuration.

The pipe member 11 is formed with an aperture 22 extending through its wall immediately adjacent and downhole of first pivot 14. Aperture 22 is circular and is of essentially the same diameter as valve member 12. When the valve member 12 moves from its closed position shown in FIG. 1 to a fully open position of FIG. 3 it is received in and occupies the aperture 22. FIG. 2 shows the valve member 12 when part way between the closed position of FIG. 1 and the fully open position.

The primary purpose of the aperture 22 is to act as a recess in which the valve member 22 lies flush or recessed, when in the open position, so as not to present any impediment to the passage of objects or the flow of fluid.

Aperture 22 is in the embodiment shown in the Figures formed as a through-going hole in the wall of pipe member 11. This construction is preferred because it is easy to create such a formation from outside the pipe member 11.

The existence of such a through-going hole however would in the absence of further measures provide a bypass path for drillpipe fluid, such that the fluid might leak out of the pipe member 11 when the valve member 12 occupies the open position.

In the preferred embodiment of the invention such leakage is prevented by the presence of a hollow, cylindrical housing (not shown in FIGS. 1 to 3) that encircles the exterior of the pipe member 11 so as to close the aperture 22 which thus in combination with the housing in effect defines a depression, in the inner wall of pipe member 11. As stated the valve member 12 is receivable in the depression.

The housing may be secured onto the exterior of the pipe member 11 in any of a variety of per se known ways. The housing if desired may include at its ends the threaded sections, mentioned above, for securing the valve assembly 10 to drillpipe at each end. Alternatively, as stated, the threaded sections may be formed in the ends of the pipe member 11.

Other ways than that described of defining a recess for the valve member 12 in its open position are within the scope of the invention.

The resiliently contractile arm 17 in the preferred embodiment shown adopts a "telescope" construction in which a first (in the preferred embodiment, downhole) arm member 17*a* is hollow and is of a larger inner diameter than the exterior diameter of a second, uphole arm member 17*b* partially inserted therein.

The second arm member 17*b* is slideable longitudinally inside the first arm member 17*a*. Within the first arm member 17*a* the two arm members 17*a*, 17*b* are interconnected by a resiliently deformable spring (not visible in the drawings) that resists compressive contraction of the arm 17.

The result of this arrangement is that the arm 17 exerts a force urging the valve member 12 towards the closed position shown in FIG. 1. In the absence of other forces acting on the valve member 12 or arm 17 therefore the fluid flow path along the drillpipe 11 via its two open ends is closed off.

Other means however of constructing the arm 17 are possible within the scope of the invention, the most important aspect of the design of arm 17 being that when the valve 10 is closed or partly closed it presents a portion on the downhole side of valve member 12 that can be acted on by objects such as but not limited to logging tools, drop balls and other oil/gas well components moving in an uphole direction for example under the influence of drillpipe fluid pumped in a "reverse" direction or while being pulled by wireline. Such engagement as explained below opens the valve 10 to permit the object to pass through the valve, which would otherwise represent an impenetrable obstruction in the uphole direction.

In use of the valve 10 therefore an object as aforesaid is initially lowered on wireline or, conceivably, pumped using drillpipe fluid in a downhole direction until it lands on a landing collar at the downhole free end of the drillpipe string or is otherwise regarded as "deployed". During this motion the object will pass through each of the valve assemblies 10 in the drillpipe (the valves typically being present at regular intervals). This is possible either because of drillpipe fluid pressure acting in the downhole direction opening the valve member 12, or more commonly because of contact of the object with the uphole side of the valve member 12 achieving this effect.

Figure 3:
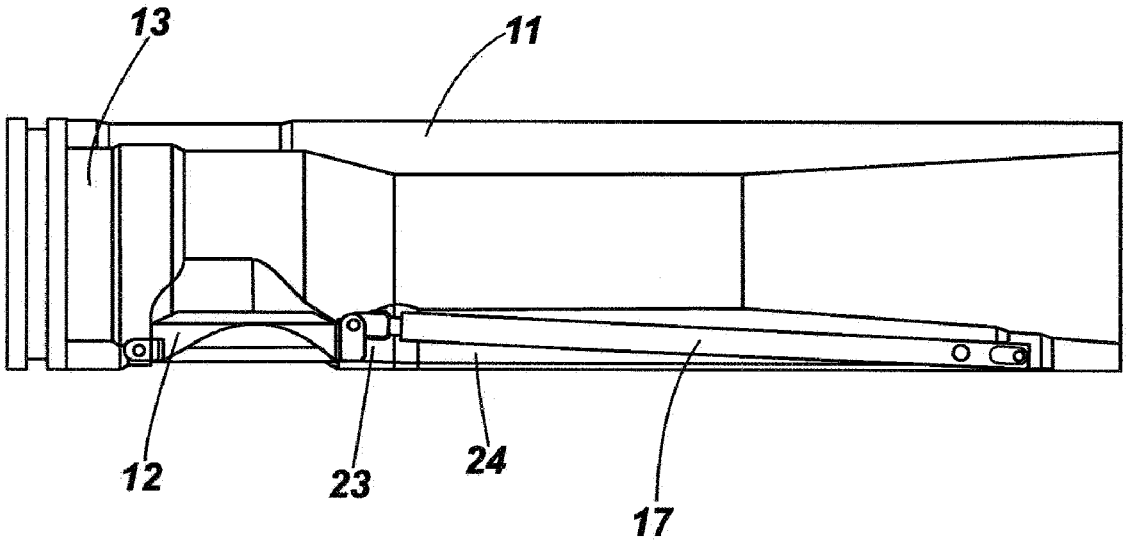
FIG. 3 shows the valve assembly of the first embodiment fully open.

When opened the valve member 12 moves via the configuration shown in FIG. 2 to that of FIG. 3 in which it sits in the aperture 22 so as not to protrude into the interior of the pipe member 11.

Following passage of the object the valve member 12 returns under the restoring force of the arm 17 to the closed position of FIG. 1.

Following landing of the object at the downhole end of the drillpipe string any wireline optionally may be disconnected (using a per se known release technique). The wireline is then withdrawn to a location uphole of the valve member 12 such that the latter moves to its closed position.

The logging tool may then be activated so that it performs its operations. In the case of a self-powered logging tool the tool logs data on the formation surrounding the end of the drillpipe. As necessary the drillpipe may be withdrawn in a controlled manner in order to permit logging of a length of the wellbore.

Assuming it is desired to return the object to a surface location without withdrawing a significant length of drillpipe following completion of the operations a wireline catcher on the downhole end of the wireline may be passed in the downhole direction through the valve defined by valve member 12 in order to attach to the uphole end of the logging tool. Winding in of the wireline then unlands the object from the downhole end of the drillpipe and causes it to travel in an uphole direction inside the drillpipe.

In another mode of use of the apparatus of the invention the circulation of drillpipe fluid is reversed in accordance with per se known techniques in order to achieve a similar effect by pumping the object in an uphole direction.

As the object approaches, from the downhole direction, the arm 17 of a valve 10 according to the invention it engages the arm and presses it towards the wall of the pipe member 11. This together with the ability of the arm 17 to contract while pivoting at each pin jointed pivot 16, 18 draws the valve member 12 to pivot to its open position occupying the aperture 22. This in turn permits unhindered passage of the object in an uphole direction through the valve 10, which as a result of the resilience of the arm 17 closes behind the object after it has passed through.

As is conventional in drillpipe designs the wall of pipe member 11 is formed with various tapers that give rise to variations in the thickness of the wall. At the location occupied by the valve member 12 when in its open position a tapered part of the wall may be formed with a recess 23 that accommodates the valve member 12 so as not to protrude beyond the dimension of the wall. The recess 23 may be present in addition to the aperture 22 or as an alternative thereto.

A similar, but longer, recess 24 formed also in the wall accommodates the arm 17 so that it does not protrude into the interior of the drillpipe when the valve 10 is fully open. This ensures smooth passage of the object being retrieved.

Recess 24 is longer than recess 23 in the elongate direction of the drillpipe 11 in order to accommodate the length of the arm 17. Arm 17 is chosen to be significantly longer than the diameter of valve member 12. This provides an adequate moment when an object moving uphole in the drillpipe 11 engages the arm 17, with the result that the force required to open the valve 10 under such circumstances is within the capabilities of the wireline or, if present, the drillpipe fluid pump.

Exemplary, non-limiting forms of the recesses 23, 24 are visible in the figures and are best illustrated in FIG. 3. They may take other forms as desired.

In the event of e.g. formation fluid pressure (or any other high pressure) acting in an uphole direction in the drillpipe 11 as a result of well kicking the resulting force is reacted in part by the valve member 12 which as noted normally occupies the closed position. This effect forces the valve member 12 tightly into engagement with the collar 13 thereby preventing the formation fluid pressure from acting uphole of the valve 10.

FIGS. 4 to 7 illustrate in perspective, partially sectioned view a second embodiment of the invention. FIGS. 4 to 7 also illustrate the main steps in one form of a method according to the invention.

In FIGS. 4 to 7 corresponding components to those shown in FIGS. 1 to 3 are identified by the same reference numerals, except that in FIGS. 4 to 7 the numerals are "primed".

In FIGS. 4 to 7 the valve assembly 10' adopts a somewhat similar configuration to that of FIGS. 1 to 3.

Thus a hollow, elongate pipe member 11' is securable in a drillpipe string so as to provide a valve assembly at a chosen location along a wellbore.

A valve member 12' that is essentially circular is pivotably secured at one edge, by way of a pin joint-type pivot 14, to the inner wall of pipe member 11'.

A resiliently contractile arm 17', that may optionally be of the same design as arm 17 of FIG. 1, is pivotably secured at a second pin-jointed pivot 16' to the opposite edge location of valve member 12' to that of pivot 14.

As in the case of FIGS. 1 to 3 each of the pin-jointed pivots 14', 16' is defined by a respective tab in the form of a perforated ear 19'.

The wall of pipe member 11' is formed with a through-going aperture 22' that defines a recess in which the valve member 12' is receivable, so as not to protrude into the interior of pipe member 11', when occupying its open position.

The aforesaid wall of the pipe member 11' is also formed with a recess 23' for receiving the contractile arm 17' at the same time.

FIGS. 4 to 7 illustrate in addition a housing 26' in the form of a hollow cylinder tightly encircling the exterior of pipe member 11'. Housing 26' closes off aperture 22' so as to prevent leakage of drillpipe fluid via aperture 22', as explained above.

Figure 4:
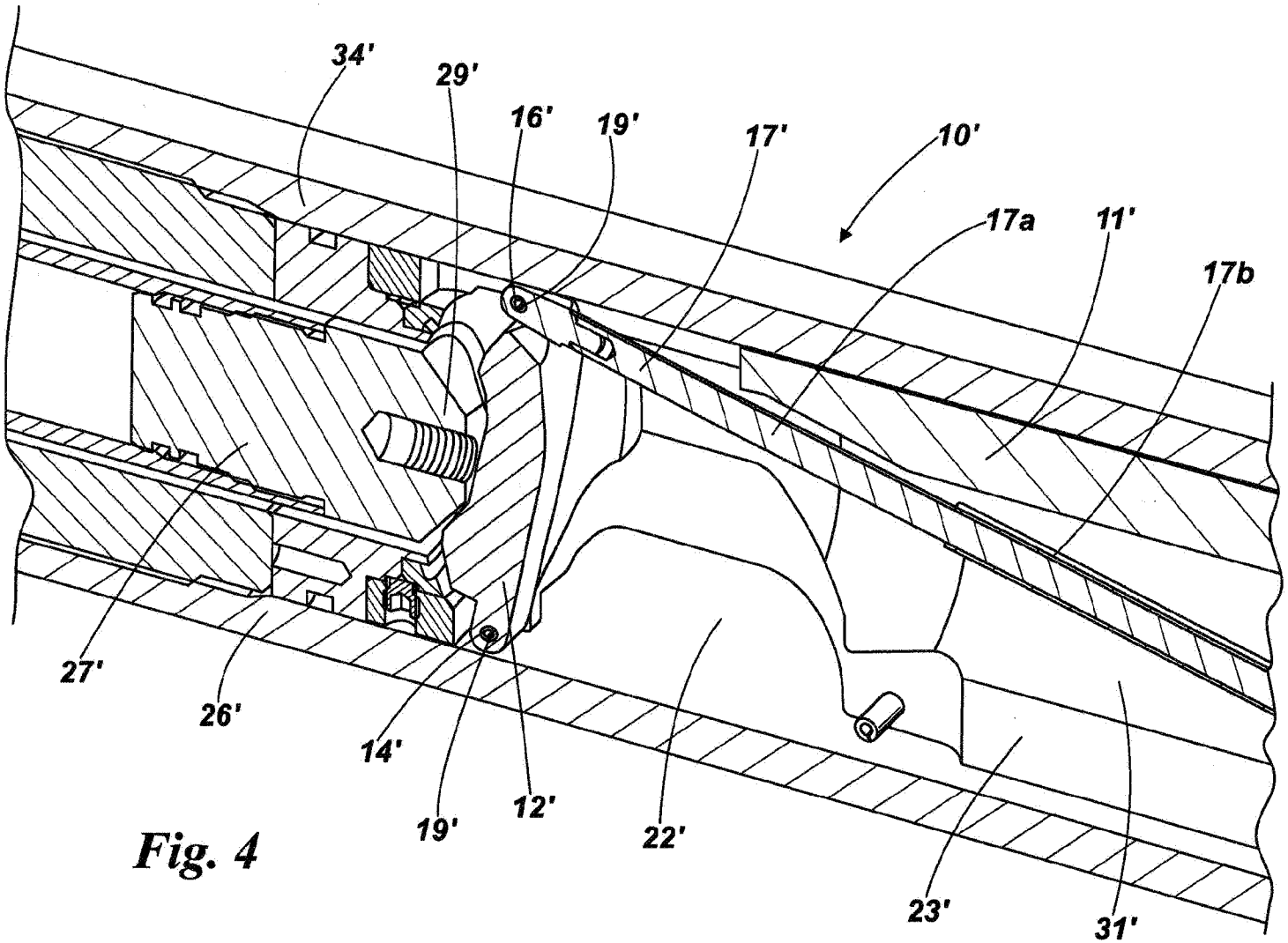
FIG. 4 shows in perspective, partly sectioned view a second embodiment of valve, according to the invention, at a time when an end of a logging tool (sonde) has engaged and partly opened the valve.

In FIG. 4 a logging tool 27', being exemplary but not limiting of the kind of object that may pass along drillpipe, is shown approaching the uphole side of valve member 12', in accordance with the method of the invention. The logging tool 27' may be any of a range of types.

As indicated the method may involve lowering the object on wireline of the general kind known in the art, or (in the case of some types of object) pumping it along the drillpipe using the pressure of circulating drillpipe fluids.

In any event when the object moves in a downhole direction its forwardmost part 29' engages the uphole side of valve member 12' such that continued movement causes the logging tool 27' or other object to move the valve member 12' towards its open position.

Such opening of the valve member 12' takes place against the resilience of the arm 17', which therefore contracts while pivoting at either end. Such contraction occurs as a result of inner arm part 17*a* sliding longitudinally within an outer sleeve 17*b* against the resilience of a spring acting between the arm parts 17*a* and 17*b*.

The uphole face of valve member 12' may if desired be profiled for example as shown in FIGS. 4 to 7 so as to promote smooth, non-snagging contact by the forwardmost end 29' of the logging tool.

Once the logging tool 27' has advanced further in a downhole direction the valve member 12' is fully opened and lies received in the recess 22' formed in the inner wall 31' of valve assembly 10'. At this time the arm 17' also is received within the further recess 23' such that neither the valve member 12' nor the arm 17' protrudes into the hollow interior of pipe member 11'.

Figure 5:
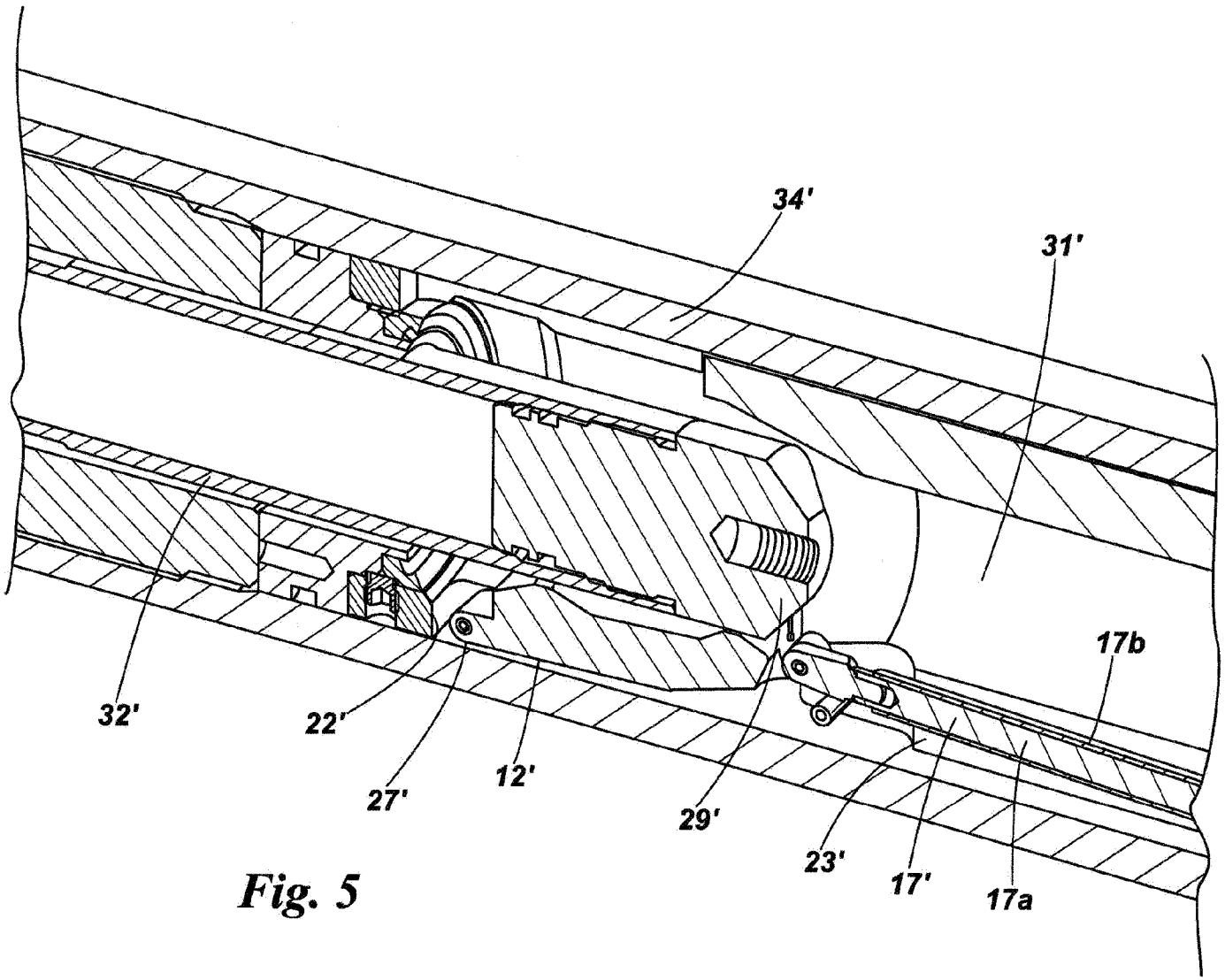
FIG. 5 shows the FIG. 4 arrangement once the logging tool has advanced along the assembly in a downhole direction so as fully to open the valve.

This allows smooth passage of the whole logging tool 27', as exemplified by side section 32' in FIG. 5, to pass unhindered in the downhole direction through the valve assembly.

Once the logging tool 27' reaches the downhole end of the drillpipe its becomes landed in a per se known landing collar so as to protrude via the open end of the drillpipe. Logging of the formation surrounding the end of the drillpipe may then take place as desired.

During logging the wireline may extend through the valve assembly 10'. Since the wireline occupies considerably less of the cross-section of the interior of the pipe member 11' than the widest part of the logging tool 27' at this time (i.e. after the logging tool has cleared, in the downhole direction, the arm 17') the valve member 12' rises out of the recess 22', under the elastic influence of the arm 17', so as to bear against the wireline in a partly-open position.

It usually is acceptable for the valve member 12' to be open while logging occurs. This is because the logging may take place over a relatively short period, during which the risk of well kicking may be assessed to be at safe levels. In any event at such a time the landed tool 27' reacts at least some of any unexpected well fluid pressure.

If however it is required to keep the logging tool 27' landed for an extended period, and the tool 27' is capable of logging autonomously (i.e. while not connected via wireline to a surface location), optionally it may be desirable to disconnect the wireline from the tool 27' and withdraw the wireline uphole through the valve assembly 10'. This causes the valve member 12' to close fully, thereby enhancing the safety of the installation.

When it is required to withdraw the logging tool in an uphole direction as necessary (i.e. if it has been disconnected as described above) the wireline may be lowered back through the valve assembly 10' in order to catch the tool 27' and unland it from the drillpipe landing ring. The wireline may then be wound in in order to pull the tool in the uphole direction out of the drillpipe.

As explained above, when wireline is extending through the valve assembly 10' the valve member 12' adopts a partly open position, protruding into the interior of pie member 11'.

The prior art valve member would have adopted generally the same configuration. This causes problems because in that case an uphole-facing shoulder 33' of the logging tool, defined in part by a reduced diameter portion 28', (or any other object moving uphole towards the valve member) would engage the valve member. This in turn causes jamming of the tool in the valve assembly. In other words when using the prior art flap valve designs it is impossible to retrieve an object in an uphole direction through the valve.

This problem is even more acute when using fluid pressure to pump an object in an uphole direction since the prior art valve member being normally closed both inhibits movement of the object and limits or prevents fluid pumping in the uphole direction.

Figure 6:
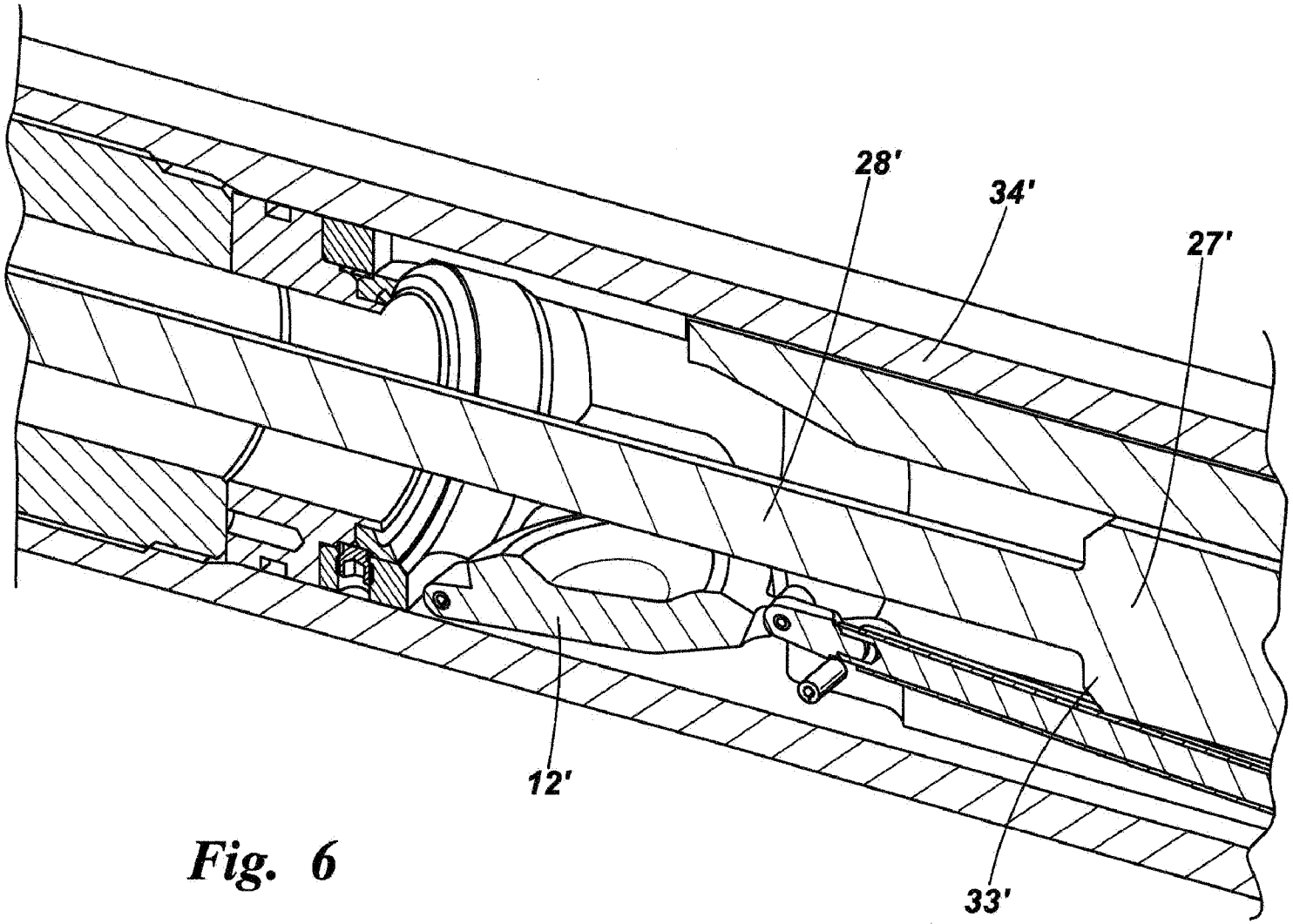
FIG. 6 illustrates the FIG. 4/FIG. 5 embodiment when the logging tool is travelling in an uphole direction.
Figure 7:
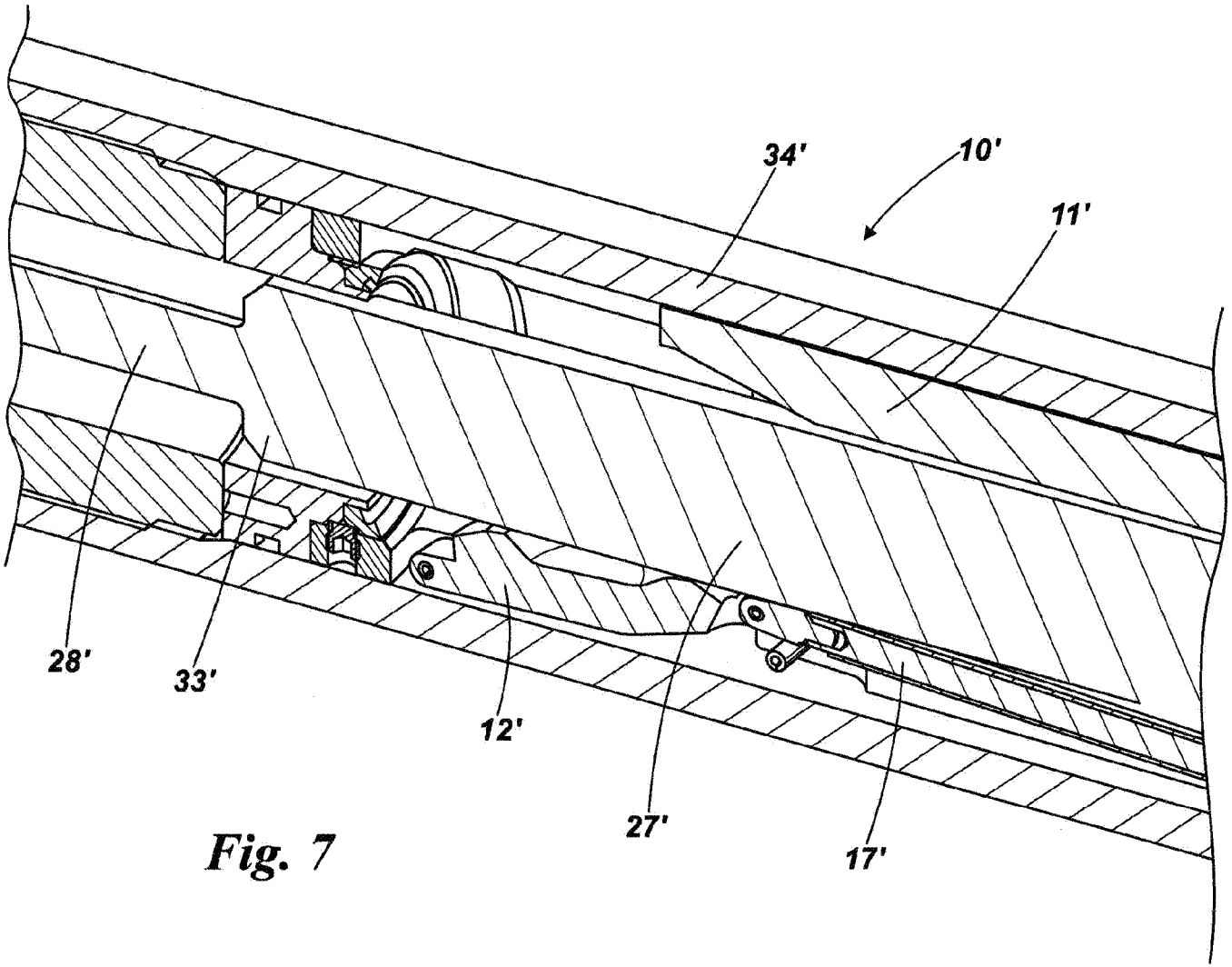
FIG. 7 shows the logging tool after having travelled further uphole than in FIG. 6.

In use of the invention, however, as best seen in FIG. 6 any uphole movement of the logging tool 27' causes its shoulder 33' to engage the arm 17' before it contacts the valve member 12'. By reason of the movement created by the arm 17' acting on valve member 12' such contact is enough to cause the valve member 12' and arm 17' to retract into their respective recesses 22', 23'. This in turn permits free passage of tool 27' in the uphole direction through the valve assembly 10', as shown in FIG. 7.

The beneficial advantages of the invention, in permitting uphole travel of objects through the valve assembly, arise for virtually any profile of object contacting the arm 17' (and not just the shoulder constituting the tool end 33' illustrated). Thus in another arrangement within the scope of the invention one may consider the uppermost end of the logging tool 27' as defining a shoulder-like reduction in diameter, in like manner to shoulder 33'. In such an arrangement the wireline itself would behave in a similar manner to reduced diameter portion 28' of logging tool 27'.

Overall the valve assembly of the invention is effective to control fluid pressures in drillpipe in a simple manner that nonetheless permits the passage of objects in either direction along the drillpipe.

The listing or discussion of an apparently prior-published document in this specification should not necessarily be taken as an acknowledgement that the document is part of the state of the art or is common general knowledge.

The invention claimed is:

1. A valve assembly comprising a pipe member defining a hollow, generally cylindrical interior having secured therein a valve member that is moveable between an open position, permitting passage of an object through the valve in first and second, opposite directions, and a closed position preventing passage of fluids along the pipe member in one of the first and second directions; and a resiliently contractile arm interconnecting the valve member and the pipe member so as to urge the valve member towards the closed position and such that when an object passes along the pipe member in the first direction the object engages the valve member to move it towards the open position and when the object passes along the pipe member in a second direction the object engages the resiliently contractile arm to cause the valve member to move also towards the open position.

2. A valve assembly according to claim 1 wherein the pipe member includes a sidewall having formed therein a recess in which the valve member is receiveable when in its open position.

3. A valve assembly according to any claim 2 wherein the valve member and the recess are circular.

4. A valve assembly according to claim 1 or claim 2 wherein the valve member includes a first pivot, on a first side, securing the valve member and the pipe member together;

and a second pivot, on an opposite side, securing the valve member and the resiliently contractile arm together.

5. A valve assembly according to claim 4 when dependent from claim 2 wherein the first pivot lies at an edge of the recess.

6. A valve assembly according to claim 4 wherein the resiliently contractile arm is secured at a first end to the valve member and at a second end, that is remote from the first end, to the pipe member.

7. A valve assembly according to claim 1 or claim 2 wherein the resiliently contractile arm includes a first, hollow arm member having slidably received therein a further, hollow arm member, the first and further arm members being interconnected inside the first said member by a resiliently deformable element.

8. The valve assembly according to claim 1 wherein the resiliently contractile arm is configured to exert a restoring force causing the valve member to return to the closed position following passage of the object through the valve assembly.

9. A method of using a logging tool comprising the steps of:

(i) causing the tool to move in a downhole direction along drillpipe including at least one valve assembly comprising a pipe member defining a hollow. generally cylindrical interior having secured therein a valve member that is moveable between an open position. permitting passing of an object through the valve in first and second. opposite directions, and a closed position preventing passing of fluids along the pipe member in one of the first and second directions; and a resiliently contractile arm interconnecting the valve member and the pipe member for urging the valve member towards the closed position and for permitting movement of the valve member towards the open position when an object passes along the pipe member in the first direction and the object engages the valve member: and when the object passes along the pipe member in a second direction the object engages the resiliently contractile arm for moving the valve member also towards the open position such that the tool is configured for passing through at least one said valve assembly in at least a forward direction;

(ii) deploying the tool at the downhole end of the drillpipe; and (iii) subsequently causing the tool to move in an uphole direction along the drillpipe such that the tool passes through at least one said valve assembly in a reverse direction.

10. A method according to claim 9 wherein the step (i) includes contact between a downhole part of the logging tool and the valve member so as to urge the valve member towards its open position; and the step (iii) includes contact between an uphole part of the logging tool and the resiliently contractile arm, also so as to urge the valve member towards its open position.

11. A method according to claim 9 or claim 10 wherein when moving along the drillpipe the logging tool is connected to wireline.

12. A method according to claim 11 including the sub-step of, after step (ii), disconnecting the logging tool from wireline to which it is connected.

13. A method according to claim 12 including the sub-step of, before step (iii), connecting the logging tool to wireline.

14. A method according to claim 9 or claim 10 wherein when moving along the drillpipe the logging tool is pumped under the influence of drillpipe fluid pressure.

15. A method according, to any of claims 9 or claim 10 wherein the tool includes an on-board memory, the method including the step of operating the tool following deployment at the downhole end of the drillpipe in order to record in the memory data pertaining to a geological formation in the vicinity of the said downhole end.

16. A method according to claim 15 including the step of, after causing the tool to move in an uphole direction, retrieving the tool to a surface location and downloading data stored in the memory.

17. A method according to claim 9 wherein following passage of the object through the valve assembly the valve member returns under a restoring force provided by the resiliently contractile arm to the closed position.

* * * * *